United States Patent [19]

Ooki et al.

[11] Patent Number: 4,802,918

[45] Date of Patent: Feb. 7, 1989

[54] CASE HARDENED STEEL AND METHOD OF MANUFACTURING THE SAME

[75] Inventors: Takao Ooki, Chita; Jun Eguchi, Nagoya, both of Japan

[73] Assignee: Aichi Steel Works, Limited, Tokai, Japan

[21] Appl. No.: 50,290

[22] PCT Filed: Aug. 22, 1986

[86] PCT No.: PCT/JP86/00434

§ 371 Date: Apr. 3, 1987

§ 102(e) Date: Apr. 3, 1987

[87] PCT Pub. No.: WO87/01396

PCT Pub. Date: Mar. 12, 1987

[30] Foreign Application Priority Data

Sep. 2, 1985 [JP] Japan ..... 60-193661

[51] Int. Cl.[4] ..... C22B 4/00

[52] U.S. Cl. ..... 75/10.61; 420/8

[58] Field of Search ..... 420/8; 75/10.61

[56] References Cited

U.S. PATENT DOCUMENTS 3,366,471 1/1968 Hill ..... 420/8

4,266,974 5/1981 Nitta ..... 420/8

*Primary Examiner*—Peter D. Rosenberg

*Attorney, Agent, or Firm*—Oblon, Fisher, Spivak, McClelland & Maier

[57] ABSTRACT

A case hardened steel having small oxygen, sulfur, and phosphorous contents and consisting essentially of, by weight, 0.10–0.30% carbon, not more than 0.50% silicon, not more than 1.50% manganese, not more than 0.012% phosphorous, not more than 0.009% sulfur, 0.02–0.04% aluminum, not more than 0.0010% oxygen, and 0.01–0.02% nitrogen, and a member or members selected from the group consisting of 0.20–1.50% chromium, 0.10–0.35% molybdenum, and 0.20–3.0% nickel, the remainder being iron together with impurities, and and a method of manufacturing the same.

The method includes performing oxidizing refinement of strictly selected raw materials in a smelting furnace, absorbing and removing a slag which is on the smelted steel poured from the smelting furnace into a container, performing reducing refinement under the presence of a highly basic slag having a basicity of not less than 3 and an inert atmosphere, performing a vacuum degassing, performing reducing refinement in a reducing atmosphere, and performing sealed casting.

4 Claims, No Drawings

CASE HARDENED STEEL AND METHOD OF MANUFACTURING THE SAME

Technical Field

The present invention relates to a high-quality case hardened steel having excellent fatigue strength, durability life, and workability for use in machine structural components of vehicles, industrial machinery, and so on; and a method of producing said steel.

BACKGROUND ART

Machine structural components must satisfy various properties including those relating to fatigue strength, durability life, workability and the like. In particular, fatigue strength is becoming increasingly important with trends toward heavier loads and higher speed together with the requirements of higher performance in industrial machinery and vehicles. Studies are being made to develop a steel having higher fatigue strength durability life, workability, and the like.

In order to improve fatigue strength, a conventional method was propsed wherein an alloying element such as Ni or Mo is added in an appropriate amount to increase the material strength. In some applications, another conventional method was proposed which uses a special smelting method such as VAR or ESR so as to control the solid texture and to reduce the amount of non-metallic inclusions.

However, in the conventional method of simply adding the alloying element, a satisfactory long durability life cannot be obtained in some applications. Again, the latter method is costly and not suitable to mass-production.

DISCLOSURE OF INVENTION

The present invention has been made in consideration of this and is based on various studies made on the influence of various alloying elements on the fatigue strength of a resultant case hardened steel. Based on such studies, it was found that the cleanliness of the steel is very important, i.e., a mere trace of oxide and sulfide inclusions considerably reduces the fatigue strength, and that other impurities impair the fatigue strength.

Based on these findings, according to the present invention, an O content is set to be 0.0010% or less which is the minimum O content that can be achieved with the current vacuum degassing refinement technique, an S conzent is set to be 0.009% or less which is considerably smaller than that in conventional steel, and the amount of impurity element P is also set to be 0.012% or less, so as to greatly reduce the amount of non-metallic inclusions in the steel, thereby obtaining an excellent fatigue strength.

Since the steel according to the present invention has a very small amount of impurities, it has excellent cold workability.

In a method of manufacturing a highly pure, case hardened steel having low oxygen, sulfur, and phosphorus contents according to the present invention, good raw materials of steel are selected and, after oxidizing refinement in an electric furnace, are poured into a ladle. The smelted steel is subjected to dephosphorization during pouring into the ladle or thereafter.

The oxide slag on the smelted steel is absorbed by a vacuum slag cleaner. A highly basic slag having a basicity of 3 or more (a reducing slag having an excellent desulfurization property such that FeO + MnO $\leqq$0.5% (by weight) and $CaO/SiO_2/Al_2O_3$=0.3 to 0.4) is prepared by electric heating. Reducing refinement is performed to reduce the amount of S to 0.009% by weight or less, the amount of 0 to 0.0020% by weight or less, and the low amount of P, while bath temperature is controlled, an inert gas is introduced through double porous bricks, under the presence of the highly basic slag, and the smelted steel is strongly agitated. Subsequently, vacuum degassing is performed by a circulating vacuum degassing apparatus such that vigorous circulating is performed during $\frac{2}{3}$ of the total treatment time while weak circulating is performed during $\frac{1}{3}$ of the total treatment time, thereby further reducing the amounts of O, N, and H. Reducing refinement is then performed by weakly agitating the smelted steel in a reducing atmosphere at a pressure higher than normal pressure to allow minute inclusions to float and be removed. Finally, sealed casting is performed to greatly reduce the O content to 0.0010% by weight or less, the S content to 0.009% by weight or less, and the P content to 0.012% by weight or less, which are greatly smaller than in the conventional steels, to provide a highly pure, case hardened steel having only a slight amount of non-metallic inclusions.

The steel according to the present invention will be described below.

A steel according to a first invention consists essentially of, by weight, 0.10–0.30% carbon, not more than 0.50% silicon, not more than 1.50% manganese, not more than 0.012% phosphorus, not more than 0.009% sulfur, one or more members selected from the group consisting of 0.20–1.50% chromium, 0.10–0.35% molybdenum, and 0.20–3.0% nickel, and 0.020–0.040% aluminum, not more than 0.0010% oxygen, and 0.0100–0.0200% nitrogen, the remainder being iron together with impurities. A steel according to a second invention is obtained by further including one or two members selected from the group consisting of 0.03–0.10% by weight of vanadium and 0.03–0.10% by weight of niobium in the steel of the first invention, further improving the fatigue strength of the steel of the first invention. The third invention concerns the method of manufacturing a high-quality case hardened steel according to the first invention, characterized by comprising absorbing a slag, which is on the smelted steel poured from a smelting furnace into a separate container, with a vacuum slag cleaner, performing reducing refinement by strongly agitating the smelted steel while adjusting a bath temperature by electrode heating under the presence of a highly basic slag having a basicity of not less than 3 and in an inert atmosphere at a pressure higher than normal pressure, performing a vacuum degassing by a circulating vacuum degassing apparatus by performing strong circulating during a $\frac{2}{3}$ period of a treatment time and weak circulating during a $\frac{1}{3}$ period of the treatment time, and performing reducing refinement by weakly agitating the smelted steel in a reducing atmosphere at normal pressure.

The reasons for limiting the contents of the respective components of the steel according to the present invention will be described below.

Carbon is an important element which must be included to achieve a core hardness by carburizing hardening. In order to achieve hardness HRC of 30 to 45 for imparting a required fatigue strength in a gear, a shaft, or the like, carbon must be contained in the amount of at least 0.10% or more. However, when C is contained in an excessive amount, it degrades machinability and impact resistance after carburizing. For this reason, the upper limit of C content in steel is set to be 0.30%. The C content is preferably 0.25% or less.

Silicon is an element necessary to improve deoxidation property and hardenability. If Si is contained in an amount exceeding 0.50%, it degrades workability such as machinability or causes an abnormal carburizing layer after carburization. For this reason, the upper limit of Si content is 0.50%. The Si content is preferably 0.35% or less.

Manganese is an element necessary to improve deoxidation and desulfurization properties and hardenability. If Mn is contained in an amount exceeding 1.50%, it degrades the workability of the resultant steel. Therefore, the upper limit of the Mn content is 1.50%.

Chromium is an element which is effective in improving hardenability and strength after hardening and tempering. When Cr is added in a carburized steel component, it improves the hardness and the effective carburizing depth of the carburizing layer. In order to obtain these effects, Cr content must be 0.20% or more. Therefore, the lower limit of the Cr content is 0.20%.

When the Cr content exceeds 1.50%, however, the steel tends to be excessively carburized when carburizing is performed, causing problems. Therefore, the upper limit of the Cr content is 1.50%.

Nickel is an element which is effective in improving toughness of a steel after hardening and tempering. In the present invention, Ni is added in an amount of 0.20% or more depending on a required hardenability and strength. When the Ni content is excessive, however, retained austenite in the carburizing layer after carburization becomes excessive, degrading the surface hardness. Also, since Ni is an expensive element, the upper limit of the Ni content is set to be 3.00% in view of economy.

Molybdenum is an element which is effective in improving a hardenability and toughness after tempering. When Mo is added in a carburized steel component, it improves the hardness and the effective carburizing depth of the carburized layer of the resultant steel. According to the present invention, Mo is contained in an appropriate amount in accordance with required hardenability, strength, and carburizing property. The lower limit of the Mo content for achieving an expected high strength is set to be 0.10%. If the Mo content is excessive, however, a carbide forms in the carburizing layer, the amount of retained austenite is increased, causing unpreferable effects. Therefore, the upper limit of the Mo content is set to be 0.35%.

Aluminum is an element which serve as a deoxidizing agent upon smelting, is combined with nitrogen to form AlN in the smelted steel, and prevents coarsening of grain during carburizing, thus controlling fine grains. If the Al content is less than 0.020%, these effects cannot be obtained; if the Al content exceeds 0.040%, large amounts of alumina inclusions form, degrading the cleanliness or machinability of the steel. Therefore, the Al content is set to be 0.020 to 0.040%.

Nitrogen is an element which is combined with aluminum to form AlN and prevents coarsening of grain during carburizing. If all the Al contained in the steel is used to form AlN, the N content must be 0.0100% or more. Therefore, the lower limit cf the N content is set to be 0.0100%. When the N content exceeds 0.0200%, toughness of the steel is impaired. Therefore, the upper limit of the N content is set to be 0.0200%.

Oxygen is an element which forms oxide inclusions that degrade the pitching resistance of a gear and the like and are harmful for the workability such as a machinability. The upper limit of the O content is set to be 0.0010%.

Phosphorus is an element which easily forms segregation in the resultant steel in a banded structure. When P segregates in the grain boundaries, the steel is embrittled. Therefore, the upper limit of the P content is set to be 0.012%.

Sulfur is an element which exists mainly in the form of a sulfide and is effective in improving a machinability. When the S content is high, however, anisotropy occurs in the resultant steel, or the cleanliness of the steel is impaired, adversely influencing the fatigue strength. Therefore, the upper limit of the S content is set to be 0.009%.

Vanadium and niobium are elements which are effective in prevents coarsening of grain during carburizing by forming carbo-nitride in a similar manner as AlN. It is necessary to contain V and/or Nb in the steel in the amount of 0.03% or more, respectively, to obtain desired effects. However, even if these elements are contained in amounts exceeding 0.10%, they are bonded with C in the steel, thus degrading hardenability. Therefore, the upper limits for these elements are set to be 0.10%.

Best Mode of Carrying Out the Invention

The characteristic features of the steel of the present invention will be described by way of examples in comparison with those of comparative and conventional steels. Note that the steel according to the present invention is obtained by smelting in accordance with the manufacturing method disclosed by the present invention.

Table 1 shows the chemical components of sample steel.

TABLE 1

| | Chemical Composition (wt %) | | | | | | | | | | | | |
|---|---|---|---|---|---|---|---|---|---|---|---|---|---|
| | C | Si | Mn | P | S | Ni | Cr | Mo | Al | O | N | Nb | V |
| A | 0.15 | 0.23 | 0.82 | 0.010 | 0.002 | 0.04 | 1.15 | | 0.028 | 0.0008 | 0.0133 | | |
| B | 0.21 | 0.26 | 0.84 | 0.009 | 0.003 | 0.05 | 1.13 | | 0.032 | 0.0009 | 0.0145 | | |
| C | 0.16 | 0.25 | 0.81 | 0.011 | 0.002 | 0.04 | 1.12 | 0.16 | 0.035 | 0.0008 | 0.0150 | | |
| D | 0.22 | 0.27 | 0.83 | 0.010 | 0.003 | 0.05 | 1.10 | 0.17 | 0.029 | 0.0010 | 0.0143 | | |
| E | 0.17 | 0.23 | 0.61 | 0.009 | 0.002 | 1.74 | 0.61 | 0.21 | 0.030 | 0.0008 | 0.0138 | | |
| F | 0.21 | 0.30 | 0.59 | 0.009 | 0.003 | 1.72 | 0.65 | 0.22 | 0.033 | 0.0007 | 0.0155 | | |
| G | 0.18 | 0.25 | 0.81 | 0.011 | 0.005 | 0.04 | 1.12 | | 0.035 | 0.0010 | 0.0153 | 0.07 | |
| H | 0.17 | 0.31 | 0.83 | 0.010 | 0.006 | 0.05 | 1.15 | | 0.035 | 0.0009 | 0.0145 | 0.05 | 0.08 |
| J | 0.20 | 0.33 | 0.85 | 0.011 | 0.004 | 0.04 | 1.13 | 0.15 | 0.037 | 0.0010 | 0.0148 | 0.06 | |
| K | 0.21 | 0.28 | 0.86 | 0.012 | 0.005 | 0.04 | 1.13 | 0.16 | 0.034 | 0.0008 | 0.0155 | 0.07 | 0.07 |
| L | 0.21 | 0.26 | 0.82 | 0.014 | 0.011 | 0.06 | 1.17 | | 0.030 | 0.0010 | 0.0137 | | |
| M | 0.18 | 0.30 | 0.83 | 0.011 | 0.008 | 0.04 | 1.11 | 0.17 | 0.035 | 0.0013 | 0.0141 | | |
| N | 0.17 | 0.27 | 0.81 | 0.018 | 0.021 | 0.05 | 1.10 | | 0.025 | 0.0021 | 0.0090 | | |

TABLE 1-continued

| | Chemical Composition (wt %) | | | | | | | | | | | | |
|---|---|---|---|---|---|---|---|---|---|---|---|---|---|
| | C | Si | Mn | P | S | Ni | Cr | Mo | Al | O | N | Nb | V |
| P | 0.18 | 0.32 | 0.78 | 0.017 | 0.023 | 0.05 | 1.12 | 0.16 | 0.027 | 0.0019 | 0.0088 | | |
| Q | 0.20 | 0.30 | 0.63 | 0.019 | 0.019 | 1.70 | 0.65 | 0.20 | 0.030 | 0.0024 | 0.0083 | | |

In Table 1, steels A to K are steels of the present invention, steels L and M are comparative steels, and steels N to Q are conventional steels.

Table 2 shows the results of an experiment for determining rolling fatigue strength, surface hardness, internal hardness, and effective carburizing depth for the test pieces each having a diameter 60 mm×length 10 mm obtained from the sample steels presented in Table 1 when these test pieces were carburized under carburizing conditions of a 0.90% of carbon potential and a carburizing temperature of 930°×5 hours, held to stand at 850° for 20 minutes, oil-quenched, and tempered at 160° for 90 minutes.

The rolling fatigue strength was measured by using a Mori-type rolling fatigue tester. The effective carburizing depth was examined in terms of a distance between a surface and a point at which the hardness was more than Hv 531.

TABLE 2

| | Rolling Fatigue Strength ($\times 10^7$) | | Surface Hardness | Internal Hardness | Effective Carburized case Depth |
|---|---|---|---|---|---|
| | ($B_{10}$) | ($B_{50}$) | (Hv) | (Hv) | (mm) |
| A | 4.32 | 9.70 | 801 | 288 | 1.10 |
| B | 4.88 | 10.1 | 782 | 345 | 1.22 |
| C | 10.5 | 24.6 | 791 | 356 | 1.18 |
| D | 5.8 | 11.3 | 772 | 405 | 1.28 |
| E | 8.7 | 10.6 | 753 | 356 | 1.20 |
| F | 7.6 | 20.5 | 747 | 395 | 1.21 |
| G | 5.6 | 12.3 | 793 | 310 | 1.16 |
| H | 4.10 | 9.8 | 785 | 315 | 1.15 |
| J | 6.85 | 18.4 | 776 | 389 | 1.22 |
| K | 5.22 | 10.8 | 769 | 400 | 1.25 |
| L | 2.58 | 5.63 | 780 | 337 | 1.18 |
| M | 2.12 | 2.77 | 759 | 329 | 1.16 |
| N | 0.95 | 1.23 | 769 | 301 | 1.15 |
| P | 1.06 | 1.97 | 778 | 375 | 1.23 |
| Q | 1.83 | 2.66 | 746 | 397 | 1.26 |

As can be seen from Table 2, regarding the rolling fatigue strengths of the conventional steels N to Q, their rated lives ($B_{10}$) are 0.95 to $1.83\times10^7$ and average lives ($B_{50}$) are 1.23 to $2.66\times10^7$. In contrast this, since the O or S content or the like is minimized in the steels A to K of the present invention, oxide or sulfide inclusions are decreased therein, thus providing greatly superior rolling life strengths over the conventional steels. Namely, the rated lives ($B_{10}$) are 4.10 to $10.5\times10^7$ and the average lives ($B_{50}$) are 9.7 to $24.6\times10^7$.

The steels L and M as comparative steels are slightly increased as to the rated lives ($B_{10}$) of $2.12\times10^7$ and $2.58\times10^7$ and the average lives ($B_{50}$) of $2.77\times10^7$ and $5.63\times10^7$ compared with the conventional steels due to the higher S and O contents than those in the steels of the present invention. However, the rated and average lives of the steels L and M are lower than those of the present invention.

Table 3 shows the results of an experiment for determining the warm forging property for test pieces when the test pieces are cut from the sample steels shown in Table 1 in a direction perpendicular to the rolling direction, and normalized by air-cooling after heating under conditions of 920°×1 hour. The warm forging property was examined in terms of a reduction of area when test pieces for tensile test each having a diameter of 6 mm were formed and subjected to the tensile test under conditions of a tensile temperature of 700° C. and a strain rate $\epsilon=10\ s^{-1}$.

TABLE 3

| | Reduction of Area (%) | | Reduction of Area (%) | | Reduction of Area (%) |
|---|---|---|---|---|---|
| A | 87 | F | 86 | L | 79 |
| B | 86 | G | 85 | M | 77 |
| C | 87 | H | 84 | N | 75 |
| D | 86 | J | 86 | P | 74 |
| E | 87 | K | 84 | Q | 87 |

As can be seen from Table 3, the steels N and P as the conventional steels containing Cr and Mo have reduction of area of 74 and 75%, respectively, and the steel L and M as the comparative steels have reduction of area of 79 and 77%, respectively. In contrast to this, all of the steels A to K according to the present invention have high reduction of area of 84% or more, thus providing an excellent warm forging property.

Table 4 shows the results of an experiment for determining austenite grain sizes of the sample steels shown in Table 1 when the sample steels were carburized under conditions of carburizing temperatures of 930° C.×6 hours, 950° C.×5 hours, and 970° C.×4 hours.

Regarding the rolling temperature, the steels N to Q as the conventional steels were rolled at 1,050° C., and the steels A to K according to the present invention and steels L and M as the comparative steels were rolled at 1,200° C.

TABLE 4

| | Grain Size | | |
|---|---|---|---|
| | 930° C. × 6 Hr | 950° C. × 5 Hr | 970° C. × 4 Hr |
| A | 8.8 | 8.2 | 3.7(21%), 8.8(79%) |
| B | 8.1 | 7.9 | 7.5 |
| C | 8.5 | 7.6 | 7.4 |
| D | 8.7 | 8.0 | 4.6(4%), 8.3(96%) |
| E | 8.8 | 7.7 | 2.8(6%), 8.7(94%) |
| F | 8.4 | 7.9 | 7.4 |
| G | 9.6 | 10.3 | 9.1 |
| H | 10.1 | 9.4 | 9.6 |
| J | 9.8 | 9.8 | 9.4 |
| K | 9.7 | 9.2 | 9.8 |
| L | 8.1 | 7.6 | 3.1(68%), 8.8(32%) |
| M | 8.3 | 7.7 | 3.4(71%), 8.7(29%) |
| N | 8.4 | 7.4 | 2.2(90%), 9.3(10%) |
| P | 8.9 | 3.1(30%), 8.6(70%) | 1.5(85%), 10.2(15%) |
| Q | 8.3 | 4.3(25%), 7.8(75%) | 1.3(95%), 10.4(5%) |

As can be seen from Table 4, the grain coarsening of the steels N to Q as the conventional steels and steels L and M as the comparative steels is considerable by high-temperature carburizing at 950° C. and 970? C. In contrast to this, the grain coarsening of the steels A to K according to the present invention is slight even when the steels are subjected to carburizing at high temperatures of 950° C. and 970° C. In this manner, the steels according to the present invention have an excellent high-temperature carburizing property.

FIG. 5 shows the results of an experiment for determining the fatigue strength, internal hardness and effective carburized case depth of test pieces prepared from steels A to Q shown in Table 1. The test pieces were prepared each to have a smoothed portion of 8 mm, and were subjected to carburizing, quenching, and annealing in the same manner as the test for determining the rolling fatigue strengths as shown in Table 2, except for the carburizing conditions of 930° C.×3 hours.

The fatigue strength was tested using an Ono-type rotation bending tester. Note that the effective carburizing depth was examined in terms of a distance from a surface to a point at which the hardness is more than Hv 531.

TABLE 5

| | Durability Limit ($\times 10^7$) | Internal Hardness (Hv) | Effective Carburized Case Depth (mm) |
|---|---|---|---|
| A | 63.8 | 305 | 0.70 |
| B | 66.2 | 357 | 0.76 |
| C | 75.6 | 363 | 0.81 |
| D | 80.8 | 421 | 0.87 |
| E | 87.3 | 373 | 0.84 |
| F | 90.0 | 411 | 0.86 |
| G | 61.7 | 336 | 0.72 |
| H | 65.8 | 338 | 0.75 |
| J | 74.6 | 411 | 0.85 |
| K | 82.1 | 421 | 0.88 |
| L | 58.7 | 323 | 0.72 |
| M | 57.2 | 316 | 0.70 |
| N | 55.5 | 310 | 0.71 |
| P | 70.3 | 385 | 0.85 |
| Q | 78.3 | 414 | 0.88 |

As can be seen from Table 5, the steel conventional steel which contains only Cr among Ni, Cr, and Mo has a durability limit of $55.5\times10^7$ and the steels L and M as the comparative steels have durability limits of $57.2\times10^7$ and $58.7\times10^7$. In contrast to this, the steels A and B according to the present invention have durability limits of $63.8\times10^7$ and $66.2\times10^7$, thus having a greatly improved fatigue strength than conventional steels.

The steels C and D accordng to the present invention which contain Cr and Mo have a superior durability limit to the steel P as the conventional steel, and the steels E and F according to the present invention which contain Ni, Cr, and Mo have a superior durability limit to the steel Q as the conventional steel. Therefore, the present invention can greatly improve the fatigue strength of Cr, Cr-Mo, and Ni-Cr-Mo steels.

As described above, according to the present invention, the S and O contents or the like in the steel are minimized, the amounts of the oxide or sulfide inclusions in the steel are reduced, and the cleanliness of the steel is thus greatly improved. As a result, the fatigue strength, durability life, and warm forging property of the structural steel are greatly increased. The present invention provides a high-quality case hardened steel suitable for vehicles, industrial machinery, and the like, and a method of manufacturing the same, which has a high practical applicability.

We claim:

1. A case hardened steel consisting essentially of, by weight, 0.10–0.30% of carbon, not more than 0.50% of silicon, not more than 1.50% of manganese, not more than 0.012% of phosphorus, not more than 0.009% of sulfur, 0.020–0.040% of aluminum, not more than 0.0010% of oxygen, 0.0100–0.0200% of nitrogen and a member of members selected from the group consisting of 0.20–1.50% of chromium, 0.10–0.35% of molybdenum and 0.20–3.0% of nickel, the remainder being iron and inevitable impurities, said steel having a high reduction of area or more than 84% in warm forging and rated rolling fatigue strength $B_{10}$ of $4.1-10.5\times10^7$ and an average rolling fatigue strength $B_{50}$ of $9.7-24.6\times10^7$ after carburizing followed by quenching and tempering.

2. A case hardened steel consisting essentially of, by weight, 0.10–0.30% of carbon, not more than 0.50% of silicon, ot more than 1.50% of manganese, not more than 0.012% of phosphorus, not more than 0.009% of sulfur, 0.020–0.040% of aluminum, not more than 0.0010% of oxygen, 0.0100–0.0200% of nitrogen, a member or members selected from the group consisting of 0.20–1.50% of chromium, 0.10–0.35% of molybdenum and 0.20–3.0% of nickel and a member or members selected from the group consisting of 0.03–0.10% of vanadium and 0.03–0.10% of niobium, the remainder being iron and inevitable impurities, said steel having a high reduction of area of more than 84% in warm forging and rated rolling fatigue strength $B_{10}$ of $4.1-10.5\times10^7$ and an average rolling fatigue strength $B_{50}$ of $9.7-24.6\times10^7$ after carburizing followed by quenching and tempering.

3. A method purifying a case hardened steel consisting essentially of carbon, silicon, manganese, phosphorus, sulfur, aluminum, oxygen, nitrogen and at least one member selected from the group consisting of chromium, molybdenum and nickel, the remainder being iron together with inevitable impurities, comprising:

(i) smelting the steel in a smelting furnace in order to oxidatively scour the steel;

(ii) pouring the smelted steel into a separate container, performing dephosphorization of the smelted steel and absorbing and removing slag which contains oxide from the steel which floats on top of the smelted steel with a vacuum slag cleaner;

(iii) conducting reducing refinement of the steel by strongly agitating the smelted steel in the presence of a highly basic slag which has basicity of not less than 3 while adjusting the temperature of the steel bath, said refinement occurring under an inert atmosphere which is under a pressure greater than normal pressure;

(iv) performing vacuum degassing of the steel with a circulating vacuum degassing apparatus which imparts strong circulation during two-thirds of the treatment, and weak circulation during one-third of the treatment; and (v) performing a reducing refinement on the steel by weakly agitating the smelted steel in a reducing atmosphere at normal pressure, said treatment thereby reducing the amounts of phosphours, sulfur, oxygen, nitrogen and aluminum to not more than 0.012%, not more than 0.009%, not more than 0.001%, 0.0100–0.0200% and 0.020–0.040% by weight, respectively.

4. The method of claim 3, wherein said case hardened steel consists essentially of, by weight, 0.10–0.30% of carbon, not more than 0.50% of silicon, not more than 1.50% of manganese, not more than 0.012% of phosphorus, not more than 0.009% of sulfur, 0.020–0.040% of aluminum, not more th an 0.0010% of oxygen, 0.0100–0.00200% of nitrogen and a member or members selected from the group consisting of 0.20–1.50% of chromium, 0.10–0 35% of molybdenum and 0.20–3.0% of nickel, the remainder being iron together with inevitable impurities.

* * * * *